US005931566A

United States Patent [19]

Fraizer

[11] Patent Number: 5,931,566

[45] Date of Patent: Aug. 3, 1999

[54] COLORED AND DECORATIVE LIGHTING

[75] Inventor: Robert L. Fraizer, Seymour, Ind.

[73] Assignee: Valeo Sylvania L.L.C., Seymour, Ind.

[21] Appl. No.: 08/542,238

[22] Filed: Oct. 12, 1995

[51] Int. Cl.[6] ..... F21V 9/00

[52] U.S. Cl. ..... 362/293; 362/510; 362/520; 362/540; 362/544

[58] Field of Search ..... 362/61, 293, 83.3, 362/242, 243, 80, 303, 333, 336, 300, 310, 328, 308, 335, 350, 375, 235, 236, 510, 520, 540, 544

[56] References Cited

U.S. PATENT DOCUMENTS

| | | | |
|---|---|---|---|
| 3,554,836 | 1/1971 | Steindorf . | |
| 3,754,135 | 8/1973 | Hulbert, Jr. | 362/293 |
| 4,006,377 | 2/1977 | Kosmatka | 362/293 |
| 4,047,020 | 9/1977 | Noren | 362/293 |
| 4,524,410 | 6/1985 | Kawakatsu et al. | 362/293 |
| 4,586,116 | 4/1986 | Kasboske . | |
| 4,587,198 | 5/1986 | Fisch . | |
| 4,763,234 | 8/1988 | Scott | 362/293 |
| 4,835,666 | 5/1989 | Feger et al. | 362/83.3 |
| 4,855,877 | 8/1989 | Otaka | 362/61 |
| 4,973,374 | 11/1990 | Karlyn . | |
| 5,010,458 | 4/1991 | Fraizer | 362/80 |
| 5,180,705 | 1/1993 | Smith . | |
| 5,219,655 | 6/1993 | Calhoun . | |
| 5,296,295 | 3/1994 | Perkins . | |
| 5,373,423 | 12/1994 | Liedtke et al. | 362/293 |
| 5,455,747 | 10/1995 | Aoyama | 362/61 |
| 5,491,586 | 2/1996 | Phillips . | |
| 5,552,969 | 9/1996 | Murakami | 362/243 |
| 5,566,057 | 10/1996 | Iwami | 362/61 |

FOREIGN PATENT DOCUMENTS

| | | | |
|---|---|---|---|
| 3922830 | 1/1991 | Germany | 362/293 |
| 94/09310 | 4/1994 | WIPO | 362/243 |

*Primary Examiner*—Sandra O'Shea
*Assistant Examiner*—Todd R. Hopper
*Attorney, Agent, or Firm*—William E. Meyer

[57] ABSTRACT

A multilayered lens for a lamp, e.g., an automotive lamp. The lens includes a transparent, unitary, polymeric lens blank having an inner surface and an outer surface; a thin, translucent, color layer disposed on, conforming to, and bonded to the inner or outer lens blank surface; and a thin, transparent, protective coating disposed on and over-lying the color layer. The color layer includes a thermoplastic polymer film of at least one color. Optionally, the film may be patterned to include two or more colored regions and/or indicia. Also disclosed are a lamp assembly, e.g., an automotive lamp assembly including the multilayered lens and methods for fabricating the multilayered lens and the lamp assembly by heat transfer of the color layer to the lens blank from a heat transfer carrier film.

13 Claims, 6 Drawing Sheets

COLORED AND DECORATIVE LIGHTING

CROSS-REFERENCE TO RELATED APPLICATIONS

The present application contains subject matter related to U.S. application Ser. No. 08/542,109, commonly assigned and filed concurrently herewith. Application Ser. No. 08/542,109 is incorporated herein by reference.

BACKGROUND OF THE INVENTION

The present invention relates to lighting, and particularly to a lamp, e.g., an automotive lamp having one or more colors applied to its lens using a thermally transferred decal. The invention also relates to this lens and to methods for producing the lens and the lamp assembly.

Lenses for automotive lamps are generally molded from polycarbonate or acrylic polymers. This practice has been successful for clear or colored lenses. However, modern automotive styling has created a need for a combination of clear and colored areas in a single lens. One example of such styling is a lens having an amber reflex within a clear lens.

Attempts have been made to produce a colored area and a clear area within a single lens by separately molding the colored shape, inserting it into a second mold, and molding the clear portion of the lens around it, a practice called "insert molding" in the art. However, insert molding is labor intensive, adding to the cost of the lens. Further, single color or clear lenses are typically overcoated with a protective, abrasion resistant, hard coating. An insert molded lens, however, cannot similarly be overcoated because of micro-cracking and failure of the overcoating at the interface of the colored insert and the clear portion of the lens.

Accordingly, it is an object of the present invention to provide a single lens of one or more colors and a lamp assembly, e.g., an automotive lamp assembly using such a lens that overcome the disadvantages of the prior art.

It is another object of the invention to provide a lamp, e.g., an automotive lamp, as well as a lens for such a lamp, having one or more colors applied to the lens surface using a thermally transferred decal and a protective coating over the color layer.

It is yet another object of the invention to expand automotive styling possibilities by fabrication of an automotive lamp lens combining colored and clear regions, or more than one colored region, that could successfully be overcoated with a protective, abrasion resistant coating.

It is still another object of the invention to provide methods for producing a lens of one or more colors and a lamp assembly including such a lens that use thermal transfer technology to apply a color layer to the surface of the lens.

SUMMARY OF THE INVENTION

In accordance with these objects, I have developed a heat transfer method for fabricating a lamp in which lens color is provided by a heat transfer decal using thermal transfer technology.

In one aspect, the invention is a multilayered lens for a lamp, e.g., an automotive lamp. The lens includes a transparent, unitary, polymeric lens blank having an inner surface and an outer surface; a thin, translucent, color layer disposed on, conforming to, and bonded to at least a portion of the inner or the outer surface of the lens blank; and a thin, transparent, protective coating disposed on and overlying at least the color layer. The color layer includes a thermoplastic polymer film of at least one color. In narrower embodiments, the film is patterned to include two or more colored regions and/or indicia.

In another aspect, the invention is a lamp assembly, e.g., an automotive lamp assembly including a housing, a light source mounted within the housing, and the above-described multilayered lens fixed to said housing, said housing and said lens together enclosing said light source.

In yet other aspects, the invention is a method of fabricating the multilayered lens or lamp assembly. The method involves forming a transparent, unitary, polymeric lens blank having an inner surface and an outer surface; applying, by heat transfer from a carrier surface, a thin, adherent, translucent, color layer on and conforming to at least a portion of the inner or the outer lens blank surface, the color layer including a thermoplastic polymer film of at least one color; and coating at least the color layer with a thin, adherent, transparent, protective coating. The method of fabricating the lamp assembly further involves mounting a light source within a housing such that light from the light source is projected in a preselected direction, and fixing the multilayered lens to the housing such the said housing and the lens together enclose the light source, the light from the light source being projected through the lens and the color layer. In a narrower embodiment, the light source is a first light source; a second light source is also mounted within the housing such that light from the first light source is projected in a first preselected direction and light from the second light source is projected in a second preselected direction, which may be the same as or different from the first direction; and the housing and lens together enclose the first and second light sources, such that the light from the second light source is projected through the lens, and the light from the first light source is projected through the lens and the color layer.

BRIEF DESCRIPTION OF THE DRAWINGS

For a better understanding of the present invention, together with other objects, advantages, and capabilities thereof, reference is made to the following Description and appended Claims, together with the Drawings in which:

DETAILED DESCRIPTION OF THE PREFERRED EMBODIMENTS

Figure 1:
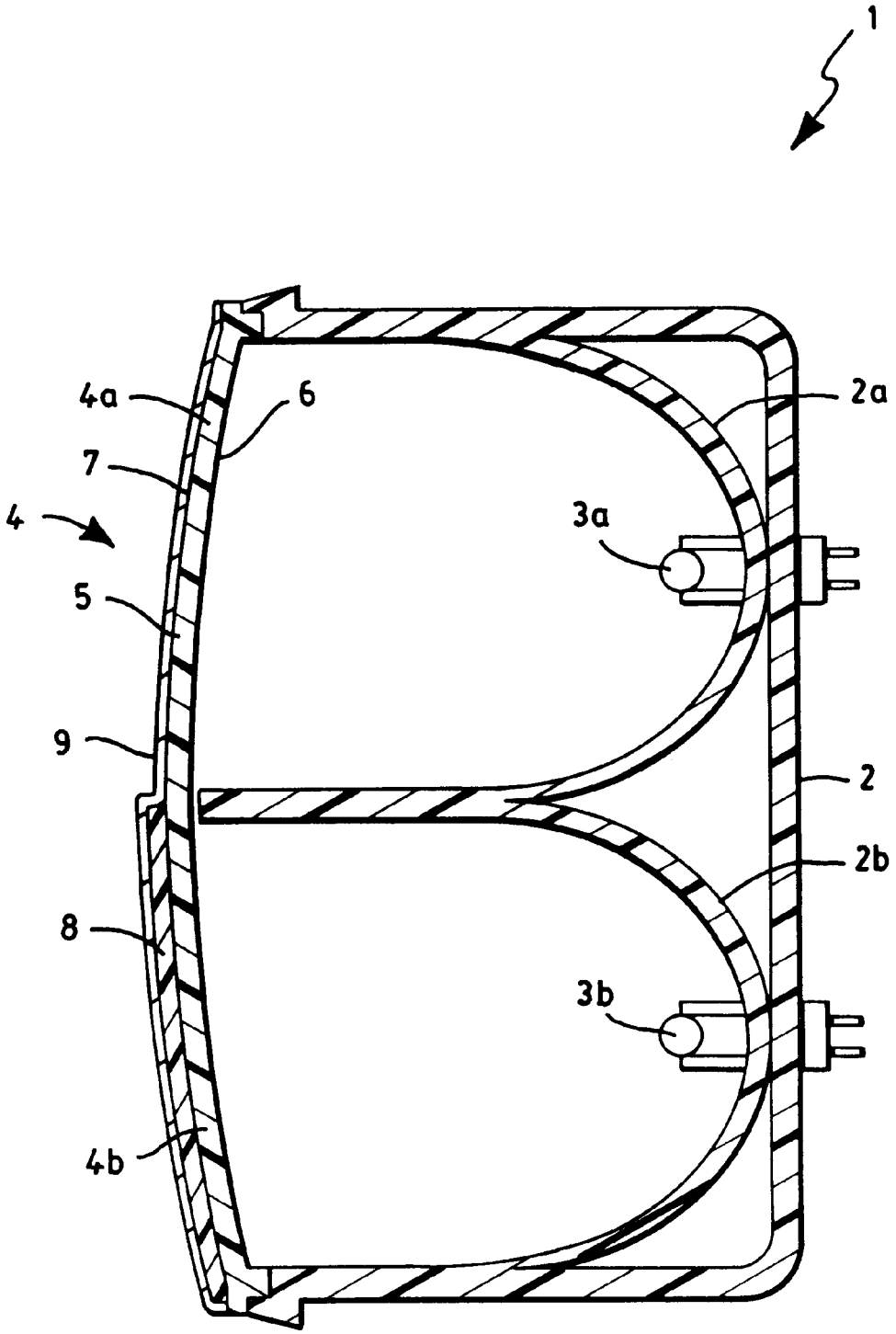
FIG. 1 is a cross-sectional elevation view of an automotive headlamp and lens in accordance with one embodiment of the present invention.

An exemplary embodiment of the lamp in accordance with the invention are described herein is an automotive headlamp including multilayered lens blank fabricated using thermal transfer techniques. The multilayered lens is a transparent, unitary, polymeric lens blank with a thin, translucent, color layer applied to its inner or outer surface using a thermally transferred, colored, heat transfer decal. A thin, transparent, protective coating overlies the color layer.

The term "heat transfer decal" as generally used in the art means an opaque or transparent printed artwork or other graphic work which has been applied, in reverse, to one side of a carrier film. The "graphic" in this embodiment can be any color or shape, and can cover the entire lens surface or only a portion thereof. The shaped decal is heat transferred to the substrate lens using thermal transfer techniques described more fully below.

The description herein of various illustrative embodiments shown in the Drawings is not intended to limit the scope of the present invention, but merely to be illustrative and representative thereof.

Referring to FIG. 1, automotive lamp assembly 1 includes housing 2 including reflectors 2*a* and 2*b*, light sources 3*a* and 3*b* mounted within reflectors 2*a* and 2*b* respectively, and lens 4 fixed to housing 2 to enclose light sources 3*a* and 3*b*. Housing 2 includes a polymeric base and a reflective coating (not shown). The polymeric base may be fabricated from, e.g., acrylic, polycarbonate, bulk molding compound (BMC, a glass fiber reinforced, thermosetting, unsaturated polyester resin material including a mold-release compound and filler material), Nylon, or polypropylene. The reflective coating may be fabricated from, e.g., vapor deposited aluminum over the entire inner reflector surface to reflect light emitted from light sources 3*a* and 3*b*. A typical thickness for the reflective coating is about 800–1000 Å.

Lens 4 is a multilayered lens having transparent, unitary, polymeric lens blank 5 as a base. Lens blank 5 includes inner surface 6 and outer surface 7. Thin, translucent, heat transferred, color layer 8 overlays and conforms to lens portion 4*b* at lens blank outer surface 7, covering light source 3*b* and reflector 2*b*. Color layer 8 includes a thermoplastic polymer film providing at least one color, e.g., red or amber, to lens portion 4*b*. Lens portion 4*a* covers light source 3*a* and reflector 2*a*, and includes no color layer. Lens portion 4*a*, light source 3*a*, and reflector 2*a* may provide, e.g., a headlamp, while lens portion 4*b*, light source 3*a*, and reflector 2*a* may provide, e.g., a turn signal or running light for an automobile. Thin, transparent, protective (e.g., abrasion resistant) coating 9 is deposited on lens blank 5 to overlie, conform to, and protect at least lens portion 4*b* and color layer 8.

When light sources 3*a* and 3*b* are activated, together or separately, their light is observed from outside lamp assembly 1 as separate regions of white and colored light, respectively, shining through a unitary lens. White light is observed through lens portion 4*a*, which includes part of lens blank 5 and, if present, protective coating 9. Colored, e.g., red or amber light is observed through lens portion 4*b*, which includes three layers: part of lens blank 5, color layer 8, and protective coating 9. Alternatively, color layer 8 and protective layer 9 may be provided on lens portion 4*b* at lens blank inner surface 6.

Figure 2:
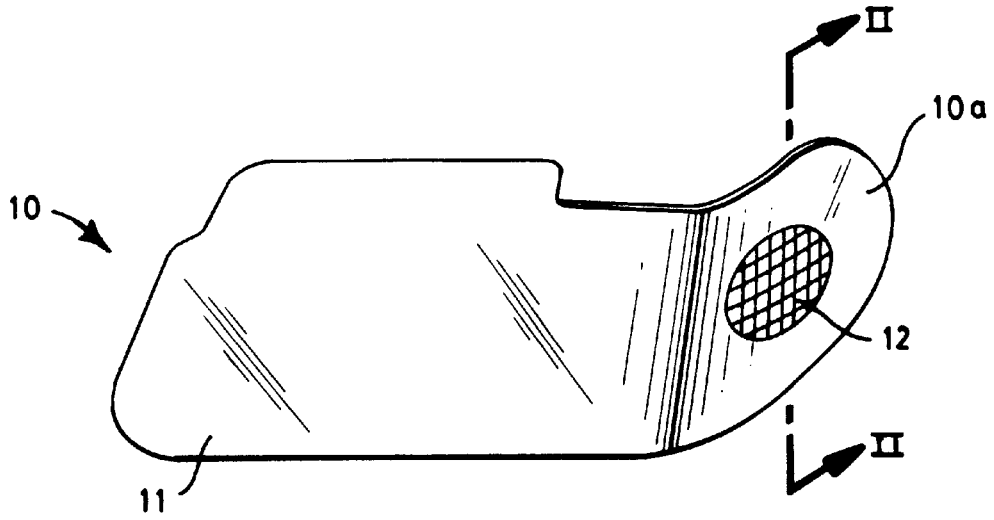
FIG. 2 is an elevation view of an automotive headlamp lens in accordance with another embodiment of the present invention.
Figure 3:
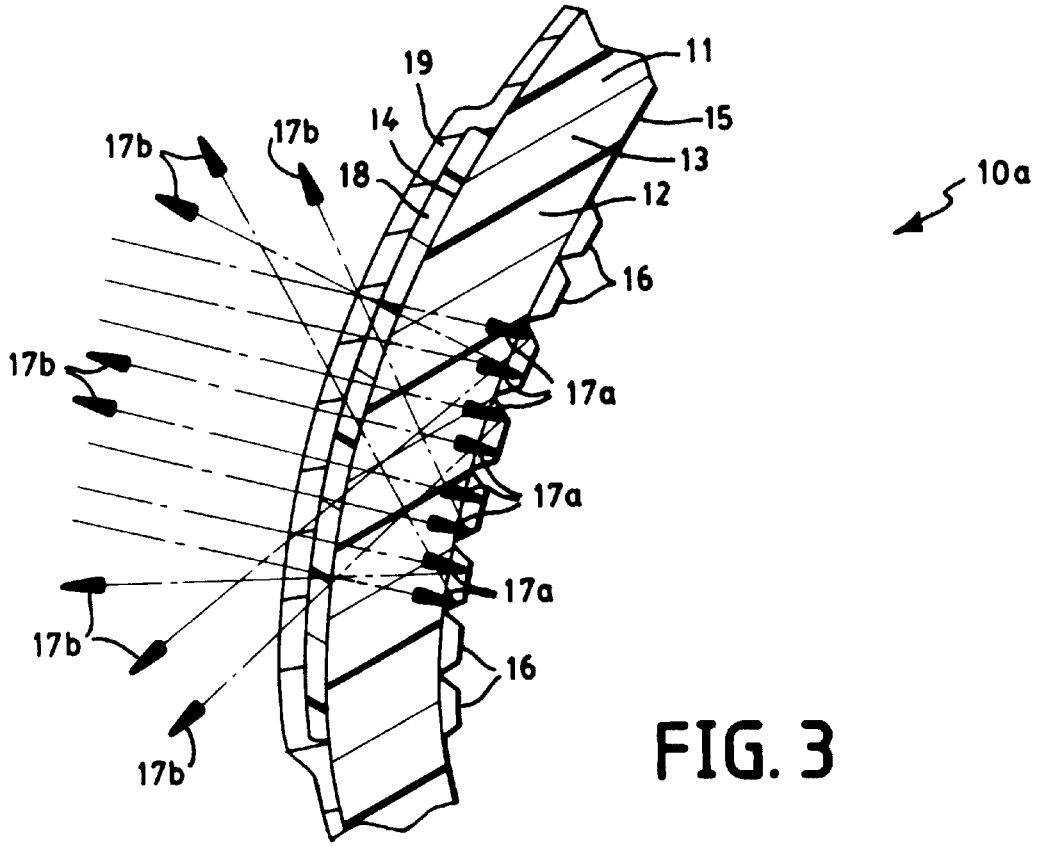
FIG. 3 is a cross-sectional elevation view of a portion of the headlamp lens of FIG. 2, taken along line III—III, showing the reflex region of the lens.

Another embodiment, illustrating the application of the invention to provide a colored reflective or reflex region in a unitary lens, is shown in FIGS. 2 and 3. FIG. 2 shows non-planar, unitary, automotive headlamp lens 10 including clear portion 11, through which passes a focused beam of light from a light source (not shown), and colored reflective portion 12, e.g. amber, on recurved end 10*a* of clear portion 11. Reflective portion 12 acts as a side reflector for the front end of an automobile.

FIG. 3 is a cross-sectional view of a portion of recurved end 10a of the headlamp lens of FIG. 2, taken along line III—III of FIG. 2, showing the multilayered nature of reflective portion 12 of lens 10. Lens blank 13 is formed from a clear polycarbonate polymeric material, and provides a base for both clear portion 11 and reflective portion 12. Outer surface 14 of lens blank 13 is smooth, while most of its inner surface 15 is slightly textured. In reflective portion 12, cubic reflectors 16 are formed at inner surface 15 to reflect light passing through lens blank 13. This reflection is indicated in FIG. 2 by arrows 17*a*, indicating light entering reflective portion 12 through outer surface 14 toward cubic reflectors 16, and arrows 17*b*, indicating light reflected by cubic reflectors 16 and exiting reflective portion 12 through outer surface 14.

Cubic reflectors typically are not truly cubic, but are formed in the shape of a truncated pyramid having generally square reflective surfaces extending generally parallel to inner surface 15. However, the term "cubic reflector", as used herein, is intended to mean any equivalent feature of the inner surface of an automotive lamp lens provided for the purpose of diffusing and/or reflecting externally generated light entering the lamp in the region of the cubic reflectors.

Translucent, heat transferred, color layer 18, including a thermoplastic polymer film typically amber in color, covers lens blank 13 only in reflective portion 12. Abrasion resistant protective hardcoat layer 19 covers the entire outer surface of lens 10, protecting color layer 18 and outer surface 14 of the lens blank. Alternatively, a protective hardcoat layer may be applied to protect only the color layer, but complete coverage of the outer surface of the lens is preferred.

Thus, light from outside the lens, e.g., white light shining on reflective portion 12 from a headlamp of an automobile approaching the lens from the side, passes through transparent hardcoat layer 19, translucent color layer 18, and lens blank 13, and is reflected by cubic reflectors 16. The reflected light passes from lens blank 13 through amber color layer 18 and hardcoat layer 19, appearing to an observer as amber light. Light approaching the remainder of lens blank 13, i.e., clear portion 11, from the same outside source is not reflected to the same degree. The amber reflection from the cubic reflectors is similar to that achieved with prior art cubic reflectors inserts. However, the disadvantages of prior art two color lenses are avoided.

Figure 4:
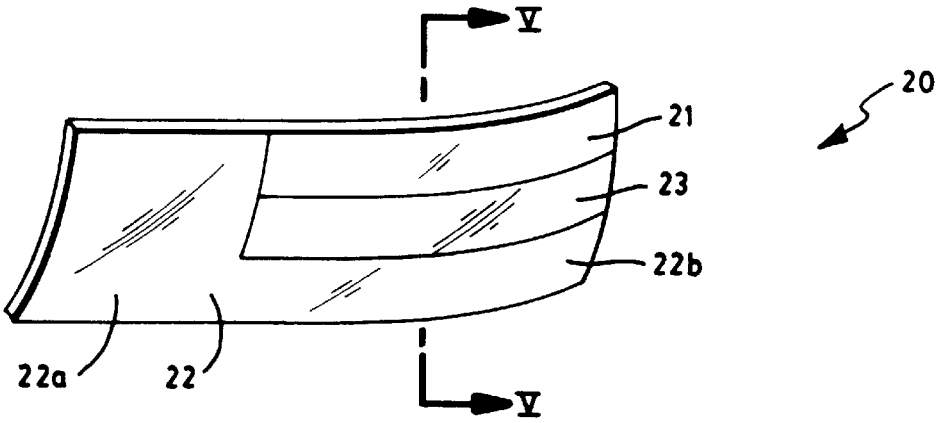
FIG. 4 is an elevation view of an automotive rear deck lens in accordance with another embodiment of the present invention.
Figure 5:
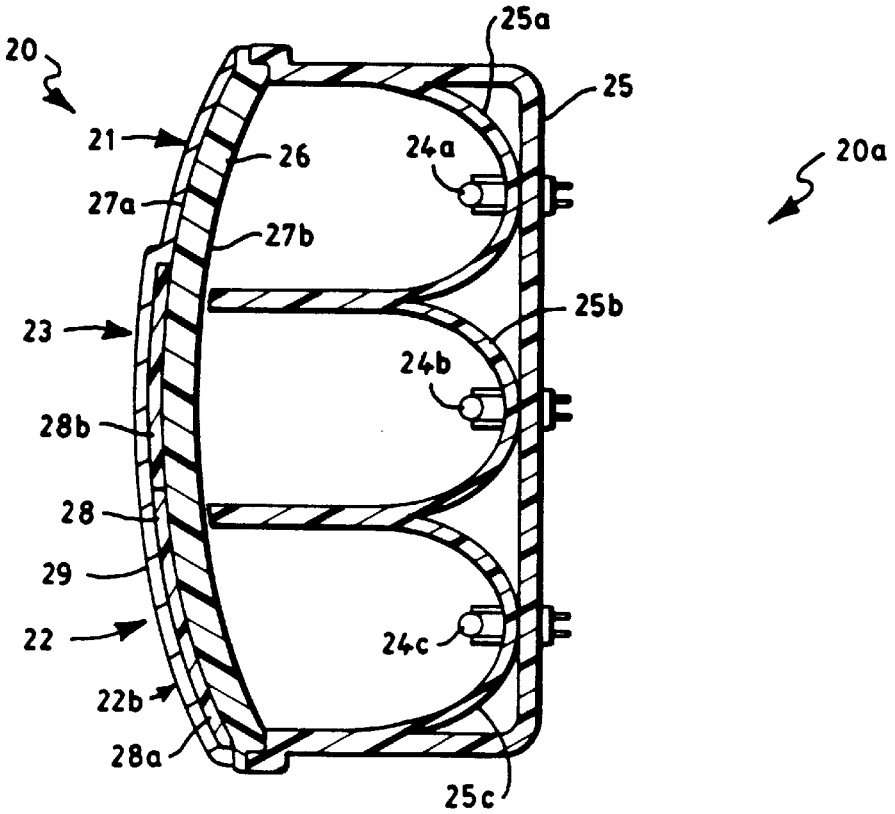
FIG. 5 is a cross-sectional elevation view of a rear deck lamp assembly including a portion of the headlamp lens of FIG. 4, taken along a line corresponding to line V—V, showing the multilayer construction of the lens.

FIGS. 4 and 5 show yet another embodiment of the automotive lens of the invention, illustrating the application of multiple colors to a clear plastic lens. In FIG. 4, unitary lens 20 for the rear deck of an automobile includes first, clear portion 21, second, colored portion 22 (including portions 22*a* and 22*b*), and third, differently colored portion 23. Clear portion 21 provides, e.g., a white back-up light, while colored portion 22 provides, e.g., a red brake light at portion 22*a* and a red running light at portion 22*b*, and colored portion 23 provides, e.g., an amber turn signal.

FIG. 5 is a cross-sectional view of rear deck assembly 20*a*, including lens 20 of FIG. 4, taken along a line corresponding to line V—V of FIG. 4 and showing the multilayered nature of the colored portions of the lens. Separate focused beams of light pass through portions 21, 23, 22*b*, and 22*a* from light sources 24*a*, 24*b*, 24*c*, and a light source (not shown) for the running light at portion 22*b*, respectively. The light sources are mounted within separate reflectors 25*a*, 25*b*, 25*c*, and a reflector (not shown) for the running light at portion 22*b* for focusing the light from the respective light sources. The separate focused beams of light are observed from outside the lens as, e.g., white (at portion 21), amber (at portion 23), and red (at portions 22*b* and 22*a*). Conveniently, all four reflectors may be provided by single housing 25 sealed to the rim of lens 20 to provide, with the four light sources, a sealed rear deck lamp assembly.

Lens blank 26 is formed from a clear polycarbonate polymeric material, and provides a base for clear portion 21 and colored portions 23, 22*b*, and 22*a*. Typically, outer surface 27*a* of lens blank 26 is smooth, while inner surface 27*b* may be slightly textured (not shown) to diffuse the light emitting from the lamp assembly. If desired, cubic reflectors similar to those shown in FIG. 3 may be formed on part or all of the inner surface of any of regions 21, 22*a*, 22*b*, or 23 to provide a reflective region.

Translucent, heat transferred color layer 28 covers lens blank 26 only in colored portions 22*a*, 22*b*, and 23. Color layer 28 includes a thermoplastic polymer film patterned to provide two colors, for example red area 28*a* to cover second, colored portion 22 (including portions 22*a* and 22*b*) and amber area 28*b* to cover third, colored region 23. First portion 21 is not covered by color layer 28. Abrasion resistant, protective hardcoat layer 29 covers the entire outer surface of lens 20, protecting color layer 28 and outer surface 27*a* of the lens blank. Alternatively, hardcoat layer 29 may be applied to protect only color layer 28, but complete coverage of the outer surface of the lens is preferred.

When any of the light sources within the lamp assembly are activated, its light is observed from outside the lamp assembly as either white, red, or amber light, depending on the lens region being illuminated, or more than one region may be illuminated simultaneously.

FIGS. 4 and 5 show two colors applied to the outer surface of the lens blank using a single two-color heat transfer layer only in the colored areas. Alternatively, a color layer may be applied over the entire outer surface of the lens blank, the part of the layer covering the non-colored area being a clear, transparent portion. Also alternatively, a color layer and a protective layer may be applied to the inner surface of the lens blank. In alternate embodiments, one or several colors may be applied by a single heat transfer decal, or separate heat transfer decals may be applied for each color. Also, one or more color regions of a color layer may include indicia, as described in further detail below.

Figure 6:
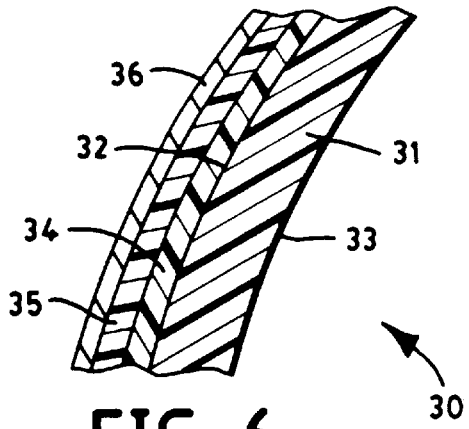
FIG. 6 is a cross-sectional elevation view of a portion of a headlamp lens in accordance with yet another embodiment of the invention, showing a second color layer overlying a first color layer.
Figure 7:
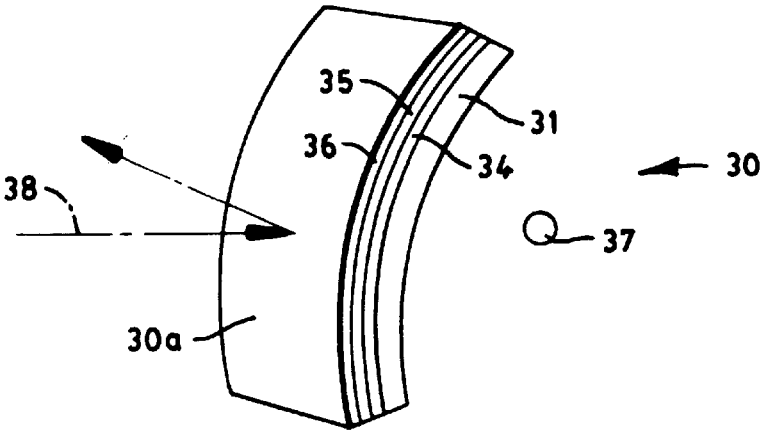
FIGS. 7 and 8 are elevation views of the headlamp lens of FIG. 6 illustrating the daytime and nighttime effects, respectively, of the lens.
Figure 8:
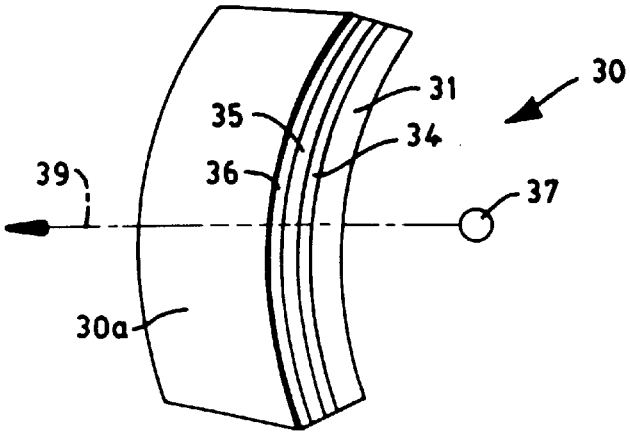

FIGS. 6, 7, and 8 illustrate still another embodiment of the invention. FIG. 6 shows lens portion 30 in which clear lens blank 31 includes outer surface 32 and inner surface 33. Translucent first color layer 34 of color "A" covers outer surface 32, and translucent second color layer 35 of color "B" overlays first color layer 34. Each color layer includes a thermoplastic polymer film, which provides its color. Color "B" of second color layer 35 is a different color from color "A" of first color layer 34. Typical examples of colors "A" and "B" are described below. Alternatively, first color layer 34 and second color layer 35 may not be coextensive. That is, the first, second, or both color layers may extend beyond the area where the layers overlap. Transparent, abrasion resistant, protective hardcoat layer 36 overlies and protects at least color layers 34 and 35.

An example of the usefulness of this embodiment is illustrated in FIGS. 7 and 8. FIG. 7 shows the typical daytime appearance of the multilayer portion 30 of the lens, i.e., when light source 37 is not activated. Daylight from outside the lamp, shown schematically by arrow 38, strikes and reflects off of outer surface 30*a* of lens portion 30, appearing to an observer as color "B", the color of second color layer 35.

FIG. 8 shows the typical nighttime appearance of the multilayer portion 30 of the lens, i.e., when light source 37 is activated. Light from light source 37, shown schematically by arrow 39, shines through lens blank 31, first and second color layers 34 and 35, and hardcoat layer 36 to lens portion outer surface 30*a*, appearing to an observer as a blend of color "A" and color "B" or, in certain cases, as color "A".

One example of a typical combination of colors is one in which "A" is red and "B" is amber. The observed colors would be amber, color "B", when the light source is inactive and orange or red-orange, a blend of "A" and "B", when the light source is active. In another example, "A" is red or amber, while "B" is another color applied as a very thin, translucent color layer. For example, "B" may be a neutral color or the same color as the automobile finish. The observed colors would be color "A", amber or the warning color red when the light source is active and color "B", a neutral color or the vehicle finish color when the light source is inactive. Thus, the lens color would blend with the color of the vehicle finish when the light source is inactive, but would change to a color required for safe operation of the vehicle when the light source is activated. (The color when the light source is activated is not observed as a blend, because the outer color layer is very thin. The optimum thickness of the outer color layer may be empirically determined.) In yet another example, the first color layer may provide indicia in color "A" alone, on a clear background, or on a background of another color, "A'", so that only color "B" is apparent when the light source is inactive, but the indicia in color "A", the indicia and color "A'", or blends, e.g., of the indicia and "A'" with "B" appear when the light source is activated. Other color combinations are possible and are within the scope of this invention.

Such combinations can provide lighting that is less obtrusive or that separates the choice of apparent lens color from the lighting colors required by safety considerations, broadening automotive design possibilities. Also alternatively, the color layers may be applied to the inner surface of the lens blank, with a color layer in color "B" being applied before a color layer in color "A", and a protective hardcoat layer being applied over at least both color layers.

Figure 9:
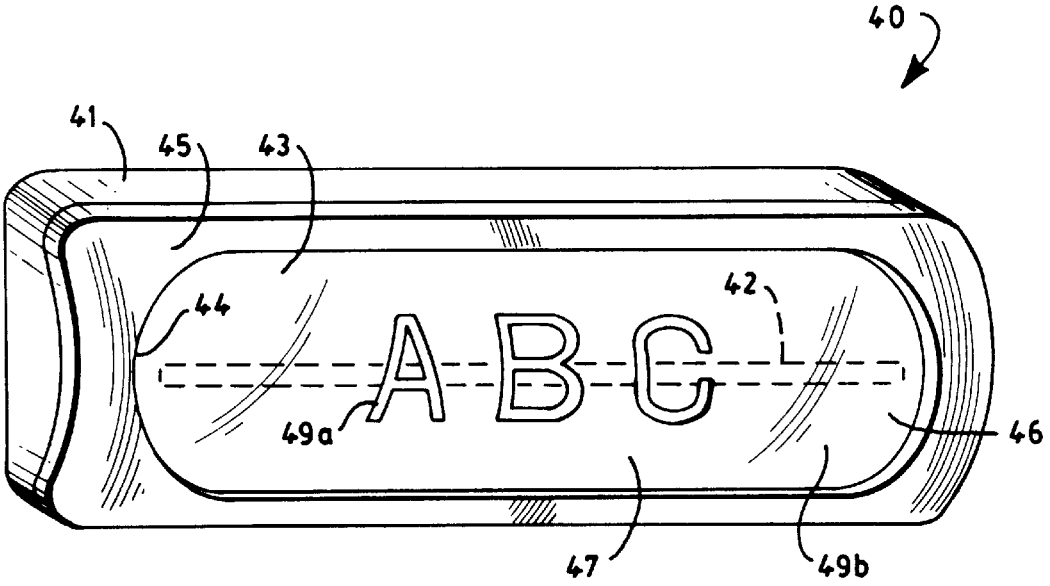
FIG. 9 is an elevation view of an automotive lamp in accordance with still another embodiment of the present invention.
Figure 10:
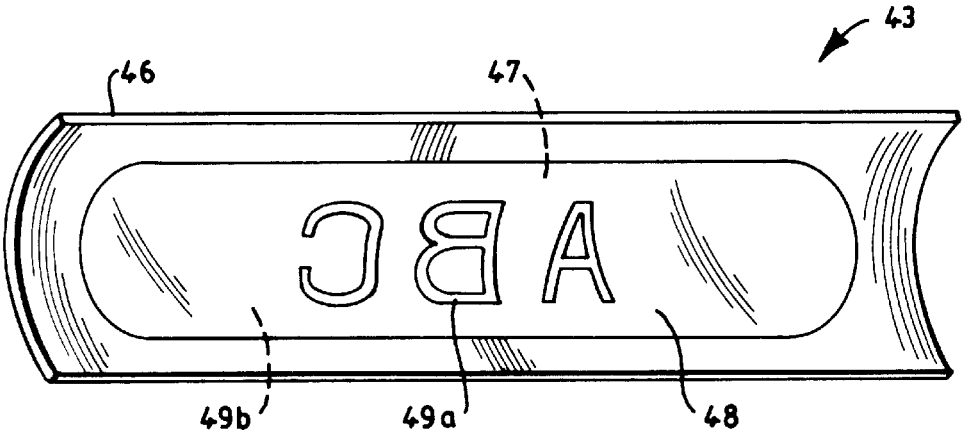
FIG. 10 is an elevation view of the reverse side of the lens shown in FIG. 9.

FIGS. 9 and 10 illustrate still another embodiment of the invention, in which a neon brake light is provided with a lens having a color layer applied thereto, as described above, the color layer including a thermoplastic polymer film exhibiting colored indicia on a background color. FIG. 9 illustrates neon lamp assembly 40 including housing 41, neon light source 42 mounted within housing 41, and non-planar lens 43. Lens 43 is mounted within opening 44 of rim 45 of housing 41 and is sealed to the rim.

FIG. 10 shows in more detail lens 43 including transparent lens blank 46, translucent color layer 47 overlying inner surface 48 of lens blank 46 positioned to be, e.g., centered within opening 44, and a transparent protective layer (not shown) overlying color layer 47. Color layer 47 includes a pattern of indicia 49*a* in, for example, opaque black, on background 49*b* in, for example, translucent red. Alternatively, a color layer may include translucent indicia, or translucent, transparent, or clear indicia on a translucent background. As used herein, the term "indicia" is intended to mean letters, numbers, lines, symbols, and other graphics used for informational or decorative purposes. Also alternatively, background 49*b* may cover the entire inner surface 48 of lens blank 46 with indicia 49*a* centered in opening 44 when lens 43 is mounted in housing 41.

Figure 11:
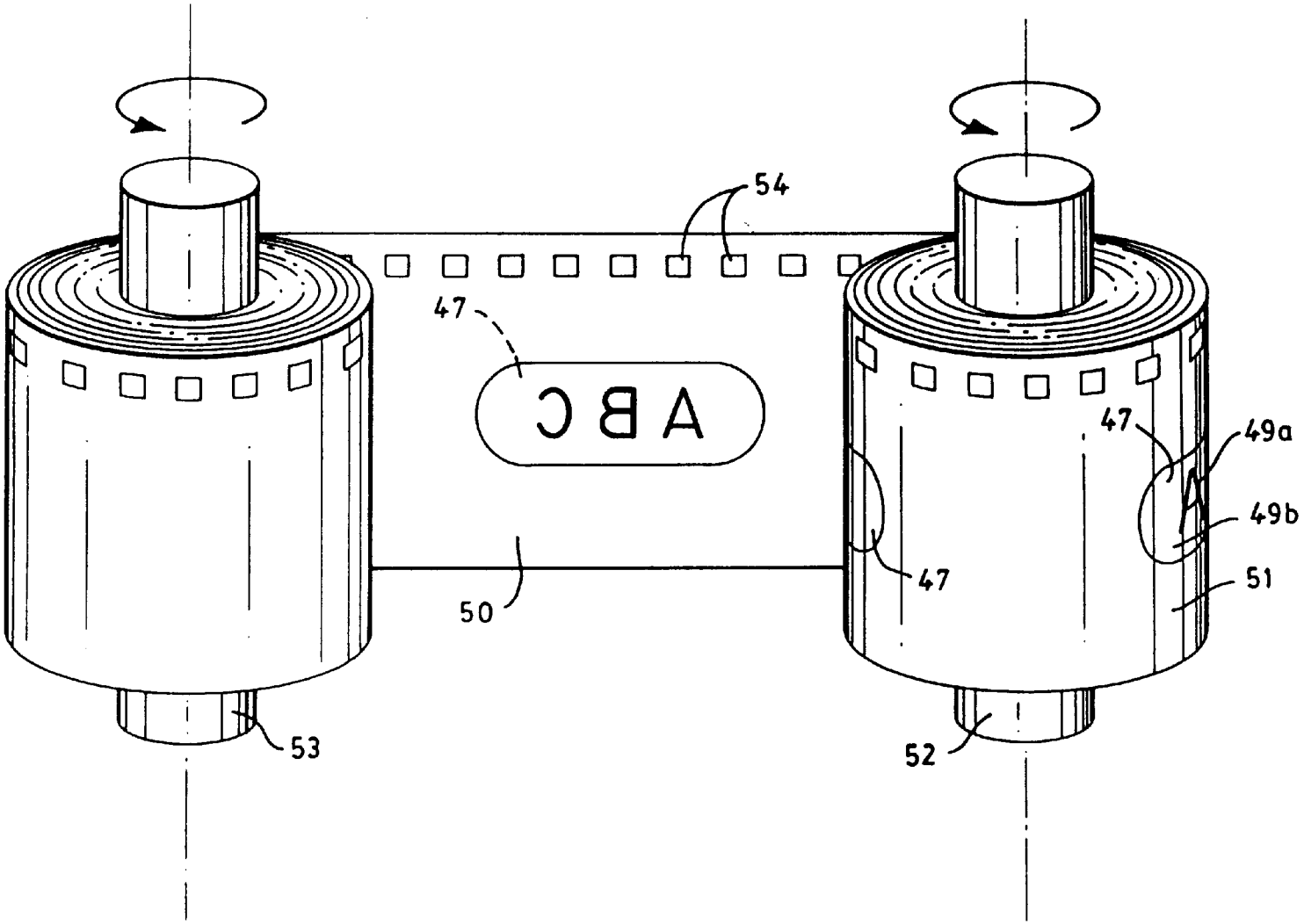
FIG. 11 is a schematic illustration of a portion of a heat transfer apparatus for applying a color layer to the lenses in accordance with certain embodiments of the invention.

FIG. 11 illustrates a typical process for the fabrication of the lenses described herein. Heat transferable carrier sheet 50 has imprinted on its surface heat transfer color layer 47, including a thermoplastic polymer film providing both indicia 49*a* and background 49*b*. Sheet 50 conveniently may be in the form of flexible sheet roll 51 wound in scroll fashion on a pair of rollers, feed roller 52 and take up roller 53. Sheet roll 51 normally includes a plurality of color layers 47 imprinted thereon, for successive transfer to a series of lens blanks (not shown).

Color layer 47 may be transferred using, e.g., a vertical heat transfer press or a roll-on heat transfer apparatus, both conventional in the heat transfer industry. A typical press operates at a temperature of about 350°–375° F., a pressure of about 400–450 lb/in$^2$, and a dwell time of about 3–5 seconds. A conventional heat transfer roll carrier (not shown) positions sheet roll 51 by means of perforations 54 in one or both of its margins to index color layer 47 to be in register with a single lens blank mounted at a transfer station (not shown). Typically, the lens blank, e.g., blank 46 shown in FIG. 10, is supported during the heat transfer process by a concave holding fixture (not shown). The holding fixture is designed to position the lens blank to locate it exactly in the proper plane and to allow no movement of the blank during the transfer operation. At the transfer station, a heating plate (not shown) heats and presses sheet 50 and color layer 47 against the lens blank for heat softening of color layer 47 and transfer of the color layer to the lens blank.

The heat transfer sheet carrier positions carrier sheet 50 in, e.g., a vertical press heat transfer apparatus with the color layer 47 indexed over the lens blank. An electric eye or mechanical stop determines the position of the carrier transfer sheet 50 and stops the linear motion. A heated vertical press is lowered to heat and press color layer 47 on carrier sheet 50 against the lens blank for a time sufficient for transfer of the color layer to the lens blank. Alternatively, the lens blank may be lifted upward and pressed against the heated press by the holding fixture. Also alternatively, a roll-on type of heat transfer apparatus may be used. A heated, e.g., silicone roller is placed over the portion of transfer sheet 50 carrying color layer 47 and is rolled slowly over the sheet surface to transfer the color layer to the lens blank. The combination of heat and pressure normally provides good adherence of the color layer to the lens blank without the use of adhesives at the color layer-lens blank interface. On lifting of the heated vertical press or heated roller from color layer 47, the bond between the color layer and the lens blank is now greater than its adhesion to the carrier transfer sheet, and the carrier sheet separates from the color layer leaving the color layer bonded to the lens blank. The coated lens blank is then removed from the holding fixture and replaced with an uncoated lens blank, while another color layer is indexed forward into register with the new lens blank for heat transfer thereto. Alternatively, a different type of heat transfer apparatus and process may be used in a similar manner to transfer the reflective coating from the carrier film to the housing blank.

The invention described herein presents to the art novel, improved lenses for lighting, e.g., automotive lighting having one or more colored regions without the use of hard polymeric colored inserts into the polymeric lens surface. This unitary construction avoids the microcracking and failure of the hardcoating on the lens at the lens-insert interface. Manufacture of the novel lens using thermal transfer techniques is less complicated and more economical than prior art insert molding techniques.

While there has been shown and described what are at present considered the preferred embodiments of the invention, it will be apparent to those skilled in the art that modifications and changes can be made therein without departing from the scope of the present invention as defined by the appended Claims.

I claim:

1. A multilayered lens for a lamp, said lens comprising:

a transparent, unitary, polymeric lens blank having an inner surface and an outer surface;

a thin, translucent, color layer disposed on, and conforming to at least a portion of a selected one of said lens blank inner and outer surfaces, said color layer including a flexible thermoplastic polymer film of at least one color having a first side and a second side, with a pre-defined area pattern, the polymer film placed in registration with respect to the lens blank and bonded to the lens blank over the area of the first side; and having a thin, transparent, protective coating disposed on and overlying at least said polymer film.

2. A lens in accordance with claim 1 wherein said film is patterned to include indicia.

3. A lamp in accordance with claim 1 wherein said lamp is an automotive lamp.

4. A lamp assembly comprising: a housing; a light source mounted within said housing; and a multilayered lens fixed to said housing, said housing and said lens together enclosing said light source, said lens comprising: (a) a transparent, unitary, polymeric lens blank having an inner surface and an outer surface; (b) a thin, translucent, colored polymer film having a first side and a second side, disposed on, and conforming to at least a portion of a selected one of said lens blank inner and outer surfaces over the area of the first side, said polymer film having, a pre-defined area pattern, the polymer film placed in registration with respect to the lens blank and bonded to the lens blank over the area of the first side; and (c) a thin, transparent, protective coating disposed on and overlying at least said polymer film.

5. A lamp assembly in accordance with claim 4 wherein said polymer film is patterned to include indicia.

6. A lamp assembly in accordance with claim 4 wherein said light source is a first light source mounted within said housing such that light from said first light source is projected in a first direction; and further comprising:

a second light source mounted within said housing and offset from said first light source such that light from said second light source is projected in a second direction, not co-linear with said first direction; and wherein said housing and said lens together enclose both said first light source and said second light source; and the light from at least one of said first and second light sources is projected through said lens and said polymer film such that the observable color from outside said assembly of the light from said first light source is different from that of the light from said second light source.

7. A lamp assembly in accordance with claim 4 wherein said lamp assembly is an automotive lamp assembly.

8. A method of fabricating a multilayered lens for a lamp, said method comprising:

forming a transparent, unitary, polymeric lens blank having an inner surface and an outer surface;

registering a carrier surface, holding a thin, adherent, translucent, polymer film having a first color, and having a pre-defined pattern with respect to a portion of a selected one of said lens blank inner and outer surfaces;

applying, heat and pressure to said polymer film to conform and bond said polymer layer to said lens;

withdrawing said carrier layer to leave said polymer film bonded to said lens, and coating at least said polymer film with a thin, adherent, transparent, protective coating.

9. A method in accordance with claim 8 wherein said lamp is an automotive lamp.

10. A method of fabricating a lamp assembly, said method comprising the steps of:

forming a transparent, unitary, polymeric lens blank having an inner surface and an outer surface;

applying, by heat transfer from a carrier surface, a thin, adherent, translucent, polymer film on and conforming to at least a portion of a selected one of said lens blank inner and outer surfaces, said polymer film of at least one color;

coating at least said polymer film with a thin, adherent, transparent, protective coating to form a multilayered lens;

mounting a light source within a housing such that light from said light source is projected in a preselected direction; and fixing said multilayered lens to said housing such that said housing and said lens together enclose said light source, the light from said light source being projected through said lens and said color layer.

11. A method in accordance with claim 10 wherein:

said light source is a first light source; said mounting step further includes mounting a second light source within said housing such that light from said first light source is projected in a first preselected direction and light from said second light source is projected in a second preselected direction, not co-linear with said first direction; and said housing and said lens together enclose said first and second light sources, such that the light from said second light source is projected through said lens, and the light from said first light source is projected through said lens and said color layer.

12. A method in accordance with claim 10 wherein said lamp assembly is an automotive lamp assembly.

13. A vehicle headlamp lamp assembly comprising:

a vehicle headlamp housing;

a first light source mounted within said housing; and a multilayered lens fixed to said housing, said housing and said lens together enclosing said first light source, said lens comprising: (a) a transparent, unitary, polymeric lens blank having an inner surface and an outer surface; wherein at least a portion of said lens blank inner surface is textured to form cubic reflectors to provide a reflective pattern visible from outside said assembly; (b) a thin, translucent, amber colored polymer film having a first side and a second side, disposed on, and conforming to at least a portion of a selected one of said lens blank inner and outer surfaces over the area of the first side, said polymer film having, a pre-defined area pattern, the polymer film placed in registration with respect to the lens blank such that said polymer film is disposed on said lens blank outer surface to overlie at least said reflective pattern; and bonded to the lens blank over the area of the first side; and (c) a thin, transparent, protective coating disposed on and overlying at least said polymer film, wherein said first light source is mounted within said housing such that light from said first light source is projected in a first direction; and a second light source mounted within said housing and offset from said first light source such that light from said second light source is projected in a second direction, not co-linear with said first direction; and wherein said housing and said lens together enclose both said first light source and said second light source; and the light from at least one of said first and second light sources is projected through said lens and said polymer film such that the observable amber color from outside said assembly of the light from said first light source is different from that of the light from said second light source.

* * * * *